US008888256B2

(12) United States Patent
Marcus et al.

(10) Patent No.: US 8,888,256 B2
(45) Date of Patent: Nov. 18, 2014

(54) ELECTRODE PRINT SPEED SYNCHRONIZATION IN ELECTROSTATIC PRINTER

(75) Inventors: Michael A. Marcus, Honeoye Falls, NY (US); Hrishikesh V. Panchawagh, San Jose, CA (US)

(73) Assignee: Eastman Kodak Company, Rochester, NY (US)

( * ) Notice: Subject to any disclaimer, the term of this patent is extended or adjusted under 35 U.S.C. 154(b) by 109 days.

(21) Appl. No.: 13/544,104

(22) Filed: Jul. 9, 2012

(65) Prior Publication Data

US 2014/0009522 A1 Jan. 9, 2014

(51) Int. Cl.

| | |
|---|---|
| ***B41J 2/085*** | (2006.01) |
| ***B41J 29/38*** | (2006.01) |
| ***B41J 2/07*** | (2006.01) |
| ***B41J 2/115*** | (2006.01) |

(52) U.S. Cl.

CPC ..... *B41J 2/115* (2013.01)
USPC ..... 347/76; 347/14; 347/74

(58) Field of Classification Search

CPC ..... B41J 2/115
See application file for complete search history.

(56) References Cited

U.S. PATENT DOCUMENTS

| | | | |
|---|---|---|---|
| 3,373,437 | A | 3/1968 | Sweet et al. |
| 3,596,275 | A | 7/1971 | Sweet |
| 4,068,241 | A | 1/1978 | Yamada |
| 6,079,821 | A | 6/2000 | Chwalek et al. |
| 6,235,212 | B1 | 5/2001 | Silverbrook |
| 6,273,559 | B1 | 8/2001 | Vago et al. |
| 6,312,110 | B1 | 11/2001 | Darty |
| 6,450,619 | B1 | 9/2002 | Anagnostopoulos et al. |
| 6,457,807 | B1 | 10/2002 | Hawkins et al. |
| 6,491,362 | B1 | 12/2002 | Jeanmaire |
| 6,505,921 | B2 | 1/2003 | Chwalek et al. |
| 6,509,917 | B1 | 1/2003 | Chwalek et al. |
| 6,554,410 | B2 | 4/2003 | Jeanmaire et al. |
| 6,575,566 | B1 | 6/2003 | Jeanmaire et al. |
| 6,588,888 | B2 | 7/2003 | Jeanmaire et al. |
| 6,663,221 | B2 | 12/2003 | Anagnostopoulos et al. |
| 6,793,328 | B2 | 9/2004 | Jeanmaire |
| 6,827,429 | B2 | 12/2004 | Jeanmaire et al. |
| 6,851,796 | B2 | 2/2005 | Jeanmaire et al. |
| 7,192,121 | B2 | 3/2007 | Barbet et al. |
| 7,364,276 | B2 | 4/2008 | Piatt et al. |
| 7,712,879 | B2 | 5/2010 | Barbet |
| 7,938,516 | B2 | 5/2011 | Piatt et al. |
| 2006/0139408 | A1 | 6/2006 | Barbet et al. |
| 2006/0209110 | A1 * | 9/2006 | Vinas et al. ..... 347/13 |
| 2009/0153627 | A1 | 6/2009 | Barbet |

(Continued)

*Primary Examiner* — Shelby Fidler
(74) *Attorney, Agent, or Firm* — William R. Zimmerli

(57) ABSTRACT

A system and method of printing includes providing print and non-print drop formation waveforms to a drop formation device of a drop ejector in response to input print data to form print and non-print drops, respectively, from a liquid jet. First and second charging waveforms are provided to a charging electrode of a drop charging device when a relative motion of a receiver and the drop ejector is provided or measured at first and second speeds, respectively. The first and second charging waveforms are independent of input print data and include first and second voltage states. The drop formation device and the drop charging device are synchronized to produce print and non-print drop charge states on print and non-print drops, respectively. A deflection device causes print and non-print drops to travel along print and non-print drop paths, respectively, with the non-print drops being collected by a catcher.

23 Claims, 11 Drawing Sheets

(56) References Cited

U.S. PATENT DOCUMENTS

2009/0225112 A1 9/2009 Barbet
2009/0231398 A1 9/2009 Barbet
2010/0033542 A1 2/2010 Piatt et al.
2010/0033543 A1* 2/2010 Piatt et al. ..... 347/77
2010/0039465 A1* 2/2010 Steiner et al. ..... 347/10

* cited by examiner

ELECTRODE PRINT SPEED SYNCHRONIZATION IN ELECTROSTATIC PRINTER

FIELD OF THE INVENTION

This invention relates generally to the field of digitally controlled printing systems, and in particular to continuous printing systems in which a liquid stream breaks into drops some of which are deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink continuously, under pressure, through a nozzle. The stream of ink is perturbed using a drop forming mechanism such that the liquid jet breaks up into drops of ink in a predictable manner. One continuous printing technology uses thermal stimulation of the liquid jet to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Recent advances in continuous inkjet printing have used drop forming mechanisms associated with the individual nozzles to control the formation of drops relative to the drop charging fields produced by a charge plate. This allows selective drops to be charged and deflected while other drops are not charged or deflected. These advances have enabled higher resolution printing when compared to earlier continuous inkjet printhead with electrostatic deflection of drops. It has been found that at certain print speeds the consistency of drop placement within the pixel regions is not ideal.

There is a need to provide improved consistency of drop placement that is independent of the print speed.

SUMMARY OF THE INVENTION

According to an aspect of the present invention, a system for printing includes a drop ejector, a transport, and a drop charging device. The drop ejector includes a nozzle and a source of pressurized liquid that provides liquid to the nozzle at a pressure sufficient to eject a liquid jet through the nozzle. A drop formation device is associated with the liquid jet. A drop formation waveform source provides print drop formation waveforms and non-print drop formation waveforms to the drop formation device in response to input print data to form print drops and non-print drops from the liquid jet with the print drops and the non-print drops traveling along an initial path. The transport provides relative motion between a receiver and the drop ejector at a first speed and provides relative motion between the receiver and the drop ejector at a second speed. The drop charging device includes a charging electrode associated with the liquid jet. A drop charging waveform source provides a first charging waveform to the charging electrode when the relative motion of the receiver and the drop ejector is at the first speed and provides a second charging waveform to the charging electrode when the relative motion of the receiver and the drop ejector is at the second speed. The first charging waveform is independent of the input print data and the second charging waveform is independent of the input print data. The first charging waveform includes a first voltage state and a second voltage state and the second charging waveform includes a first voltage state and a second voltage state. A synchronization device synchronizes the drop formation device and the drop charging device to produce a print drop charge state on the print drops and produce a non-print drop charge state on non-print drops. The print drop charge state and the non-print drop charge state are distinct when compared to each other. A deflection device associated with the print drops and the non-print drops traveling along the initial path causes the print drops having the print drop charge state to travel along a print drop path and causes the non-print drops having the non-print drop charge states to travel along a non-print drop path. A catcher is positioned to collect the non-print drops traveling along the non-print drop path while allowing the print drops traveling along the print drop path to continue traveling toward the receiver.

According to another aspect of the present invention, a method of printing includes providing a drop ejector and a drop charging device. The drop ejector includes a nozzle, a source of pressurized liquid that provides liquid to the nozzle at a pressure sufficient to eject a liquid jet through the nozzle, a drop formation device associated with the liquid jet, and a drop formation waveform source which provides print drop formation waveforms and non-print drop formation waveforms to the drop formation device in response to input print data to form print drops and non-print drops from the liquid jet with the print drops and the non-print drops traveling along an initial path. The drop charging device includes a charging electrode associated with the liquid jet and a drop charging waveform source. Relative motion between a receiver and the drop ejector is provided at a first speed and a second speed using a transport. A first charging waveform is provided to the charging electrode using a drop charging waveform source when the relative motion of the receiver and the drop ejector is at the first speed and a second charging waveform is provided to the charging electrode using the drop charging waveform source when the relative motion of the receiver and the drop ejector is at the second speed. The first charging waveform is independent of the input print data and the second charging waveform is independent of the input print data. The first charging waveform includes a first voltage state and a second voltage state and the second charging waveform including a first voltage state and a second voltage state. The drop formation device and the drop charging device are synchronized using a synchronization device to produce a print drop charge state on the print drops and produce a non-print drop charge state on non-print drops. The print drop charge state and the non-print drop charge state are distinct when compared to each other. The print drops having the print drop charge state are caused to travel along a print drop path and the non-print drops having the non-print drop charge states are caused to travel along a non-print drop path using a deflection device. The non-print drops traveling along the non-print drop path are collected using a catcher while the print drops traveling along the print drop path are allowed to continue traveling toward the receiver.

According to another aspect of the present invention, a method of printing includes providing a drop ejector and a drop charging device. The drop ejector includes a nozzle, a source of pressurized liquid that provides liquid to the nozzle at a pressure sufficient to eject a liquid jet through the nozzle, a drop formation device associated with the liquid jet, and a drop formation waveform source which provides print drop formation waveforms and non-print drop formation waveforms to the drop formation device in response to input print data to form print drops and non-print drops from the liquid jet with the print drops and the non-print drops traveling along an initial path. The drop charging device includes a charging electrode associated with the liquid jet and a drop charging waveform source. A first speed of relative motion between a receiver and the drop ejector is measured using a speed measurement device and a second speed of relative motion between the receiver and the drop ejector is measured using a speed measurement device. A first charging waveform is provided to the charging electrode using a drop charging waveform source when the relative motion of the receiver and the drop ejector is at the first speed and a second charging waveform is provided to the charging electrode using the drop charging waveform source when the relative motion of the receiver and the drop ejector is at the second speed. The first charging waveform is independent of the input print data and the second charging waveform is independent of the input print data. The first charging waveform includes a first voltage state and a second voltage state and the second charging waveform including a first voltage state and a second voltage state. The drop formation device and the drop charging device are synchronized using a synchronization device to produce a print drop charge state on the print drops and produce a non-print drop charge state on non-print drops. The print drop charge state and the non-print drop charge state are distinct when compared to each other. The print drops having the print drop charge state are caused to travel along a print drop path and the non-print drops having the non-print drop charge states are caused to travel along a non-print drop path using a deflection device. The non-print drops traveling along the non-print drop path are collected using a catcher while the print drops traveling along the print drop path are allowed to continue traveling toward the receiver.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
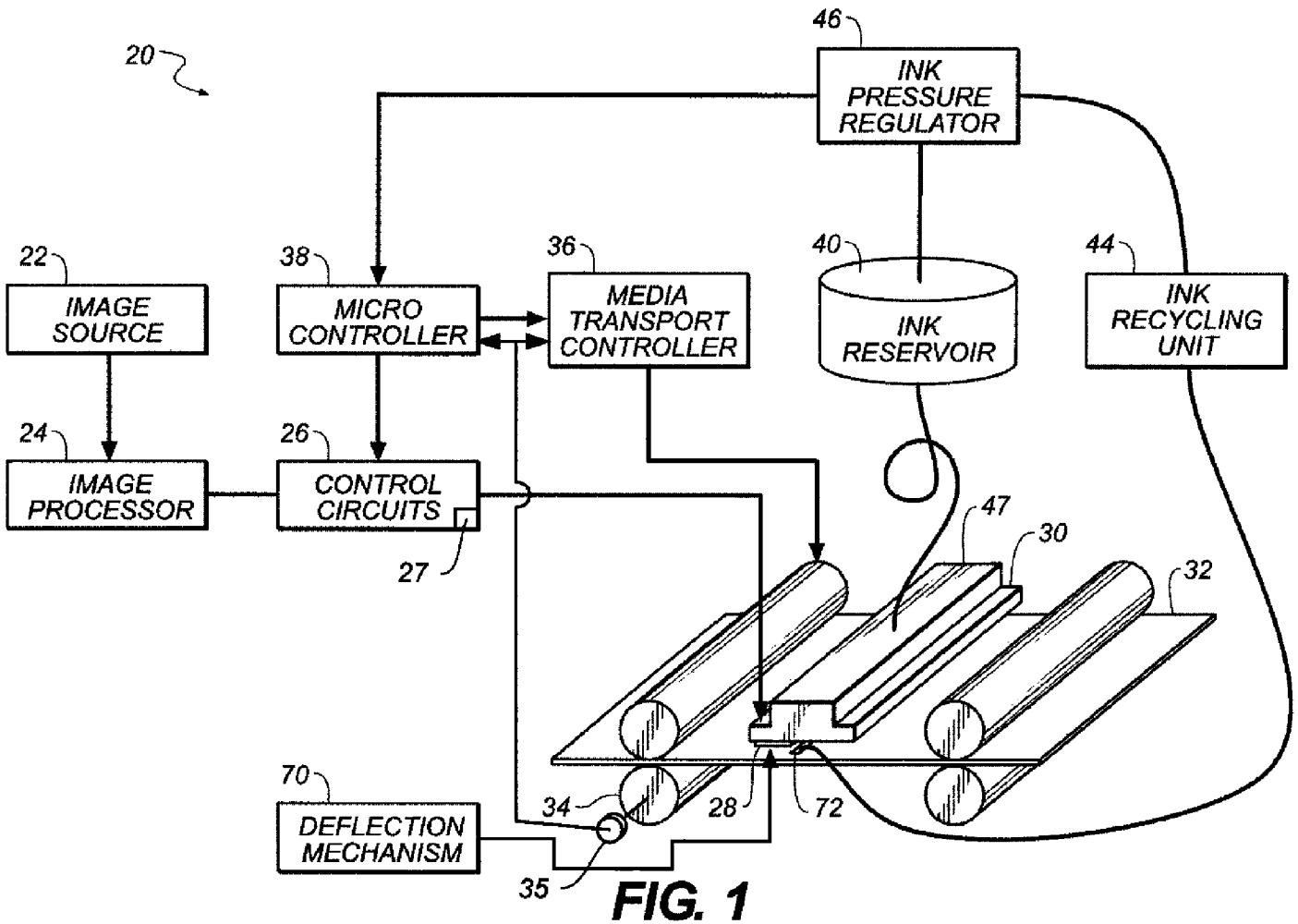
FIG. 1 is a simplified block schematic diagram of an exemplary continuous inkjet system according to the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit (image processor) 24 which also stores the image data in memory. A plurality of drop forming mechanism control circuits 26 reads data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 72 that blocks the stream and which may allow a portion of the ink to be recycled by an ink recycling unit 44. The ink recycling unit 44 reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism 70 which is described in more detail below with reference to FIGS. 2 and 3.

Figure 2:
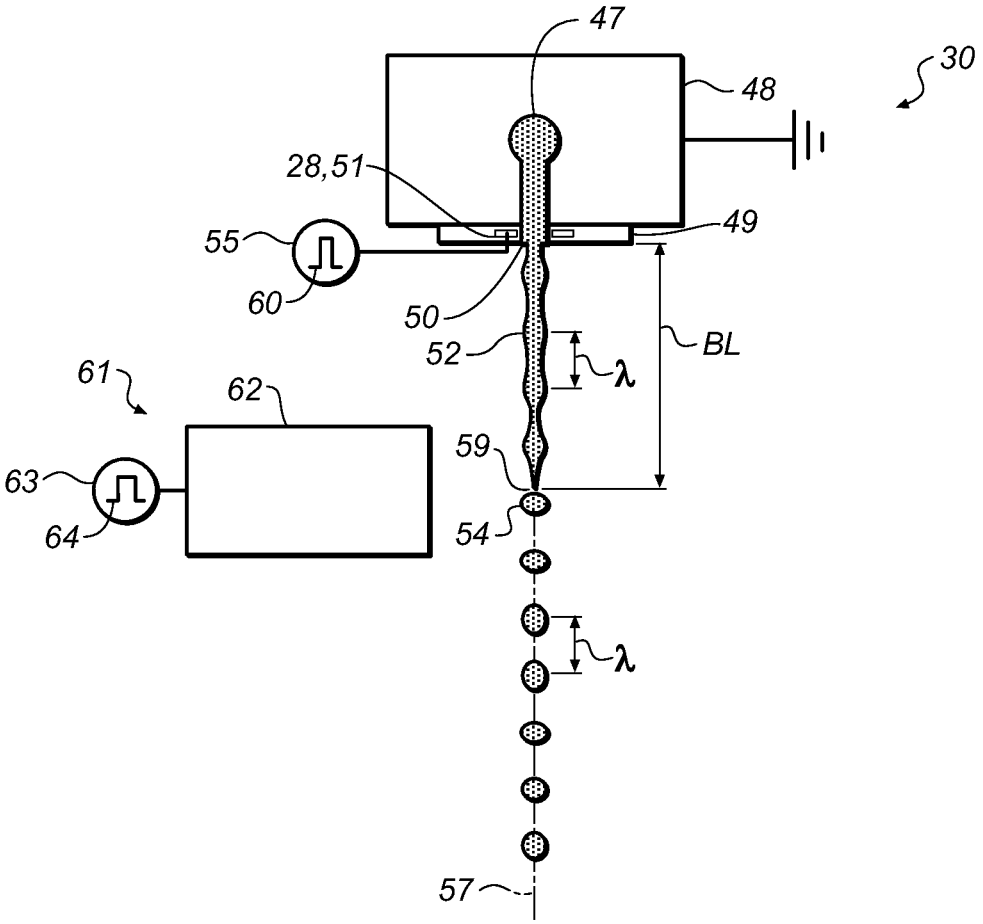
FIG. 2 shows an image of a liquid jet being ejected from a drop generator and its subsequent break off into drops with a regular period.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. Alternatively, nozzle plate 49 can be integrally formed with jetting module 48. Liquid, for example, ink, is supplied to the nozzles 50 of the array of nozzles via liquid channel 47 at a pressure sufficient to form continuous liquid streams or filaments 52 from each nozzle. In FIG. 2, the array or plurality of nozzles extends into and out of the figure.

Jetting module 48 is operable to cause liquid drops 54 to break off from the liquid stream 52 in response to image data. To accomplish this, jetting module 48 includes a drop stimulation or drop forming transducer 28, for example, a heater, a piezoelectric actuator, or electrohydrodynamic stimulation electrode, that, when selectively activated, perturbs each filament of liquid 52, for example, ink, to induce portions of each filament to breakoff from the filament and coalesce to form drops 54. Depending on the type of transducer used, the transducer can be located in or adjacent to the liquid chamber that supplies the liquid to the nozzles to act on the liquid in the liquid chamber, be located in or immediately around the nozzles to act on the liquid as it passes through the nozzle, or located adjacent to the liquid jet to act on the liquid jet after it has passed through the nozzle.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

Referring to FIG. 2 the printing system has associated with it, a printhead that is operable to produce from an array of nozzles 50 an array of liquid jets 52. Associated with each liquid jet 52 is a drop formation device 28. The drop formation device includes a drop formation transducer 28 and a drop formation waveform source 55 that supplies a drop formation waveform 60 to the drop formation transducer. The drop formation waveform source 55 is a portion of the mechanism control circuits 26. In some embodiments in which the nozzle plate is fabricated of silicon, the drop formation waveform source is formed at least partially on the nozzle plate 49. The drop formation waveform source supplies a waveform that typically comprises a sequence of pulses having a fundamental frequency $f_o$ and a fundamental period of $T_o=1/f_o$ to the drop formation transducer, which produces a modulation with a wavelength $\lambda$, in the liquid jet. The modulation grows in amplitude to cause portions of the liquid jet break off into drops. Through the action of the drop formation device, a sequence of drops is produced. As the sequence of pulses typically have a fundamental frequency $f_o$ and a fundamental period of $T_o=1/f_o$, drops are formed at the fundamental frequency $f_o$ with a fundamental period of $T_o=1/f_o$. In FIG. 2, liquid jet 52 breaks off into drops with a regular period at break off location 59, which is a distance, called the break off length, BL from the nozzle 50. The distance between a pair of successive drops 54 is essentially equal to the wavelength $\lambda$ of the perturbation on the liquid jet. The stream of drops 54 formed from the liquid stream 52 follow an initial trajectory 57.

The break off time of the droplet for a particular inkjet can be altered by changing at least one of the amplitude, duty cycle, or number of the stimulation pulses to the respective resistive elements surrounding a respective resistive nozzle orifice. In this way, small variations of either pulse duty cycle or amplitude allow the droplet break off times to be modulated in a predictable fashion within ±one-tenth the droplet generation period.

Also shown in FIG. 2 is a charging device 61 comprising charging electrode 44 and charging waveform source 63. The charge electrode 44 associated with the liquid jet is positioned adjacent to the break off point 59 of the liquid jet 52. If a voltage is applied to the charge electrode 44, the electric fields produced between the charge electrode and the electrically grounded liquid jet, the capacitive coupling between the two produces a net charge on the end of the electrically conductive liquid jet. (The liquid jet is grounded by means of contact with the liquid chamber of the grounded drop generator.) If the end portion of the liquid jet breaks off to form a drop while there is a net charge on the end of the liquid jet, the charge of that end portion of the liquid jet is trapped on the newly formed drop.

Figure 4:
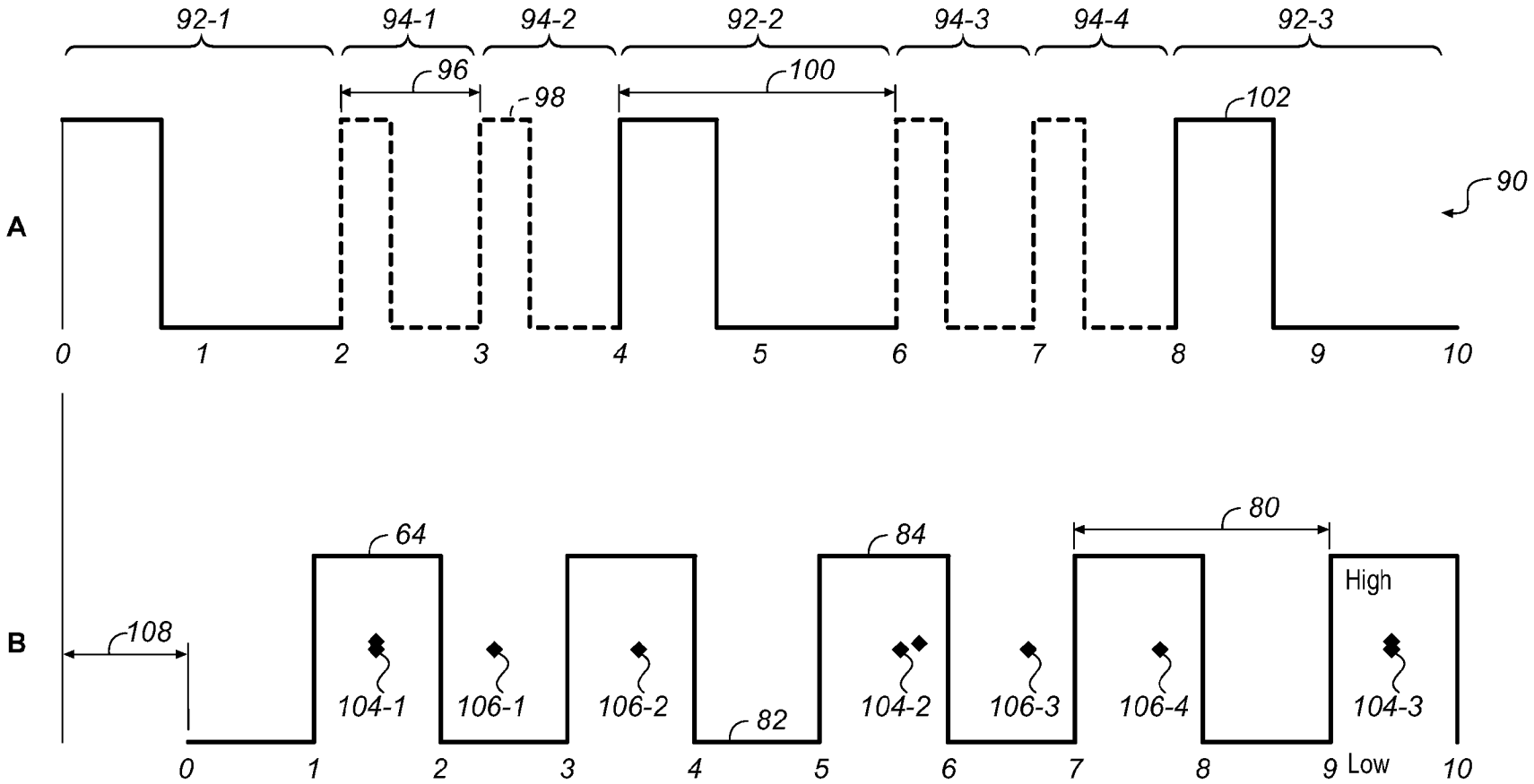
FIG. 4 shows a first example embodiment of a timing diagram illustrating drop formation pulses, the charge electrode waveform, and the break off of drops.

The voltage on the charging electrode 62 is controlled by a charging waveform source 63 which provides a charge electrode waveform operating at the charging waveform period 80, shown in FIG. 4. The charging waveform source 63 provides a varying electrical potential between the charging electrode 44 and the liquid jet 52. The charging waveform source 63 generates a charge electrode waveform 64, which includes a first voltage state and a second voltage state; the first voltage state being distinct from the second voltage state. An example of a charge electrode waveform is shown in FIG. 4B. The two voltages are selected such that drops breaking off during the first voltage state acquire a first charge state and the drops breaking off during the second voltage state acquire a second charge state. This waveform supplied to the charge electrode is independent of, or not responsive to, the image data to be printed. The charging device 61 is synchronized with the drop formation device using a conventional synchronization device 27 (shown in FIG. 1) so that a fixed phase relationship is maintained between the charge electrode waveform produced by the charging waveform source 63 and the clock of the drop formation waveform source. As a result, the phase of the break off of drops from the liquid stream, produced by the drop formation waveforms, is phase locked to the charge electrode waveform. As indicated in FIG. 4, there can be a phase shift, denoted by arrow 108, between the charge electrode waveform and the drop formation waveforms.

Figure 3:
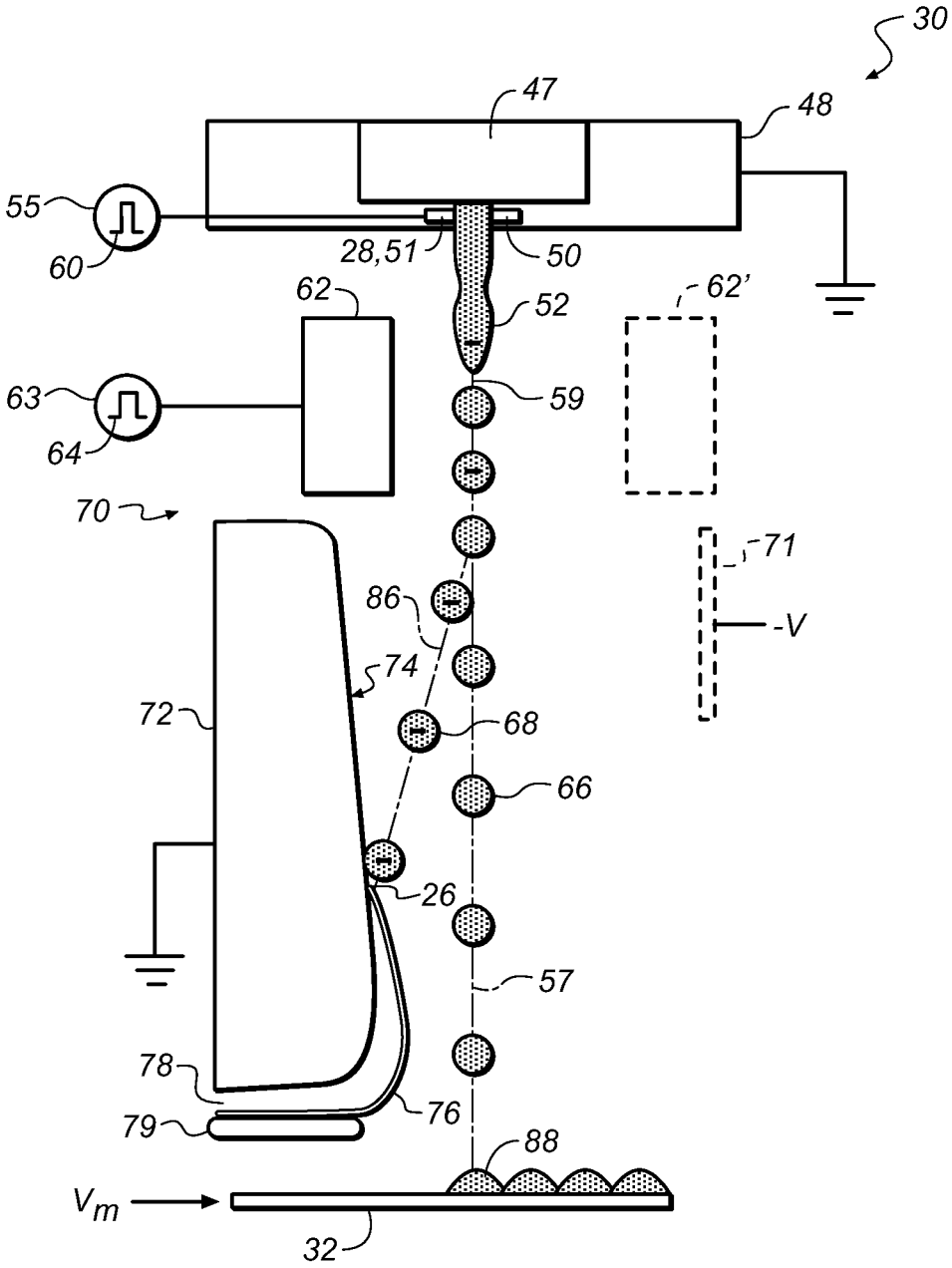
FIG. 3 shows a cross sectional of an inkjet printhead of the continuous liquid ejection system according to this invention.

With reference now to FIG. 3, wherein the printhead 30 includes a droplet generator or stimulation device 28 which creates a liquid jet 52 that breaks up into ink droplets. Selection of droplets as print droplets 66 or non-print droplets 68 will depend upon the phase of the droplet break off relative to the charge electrode voltage pulses that are applied to the to the charge electrode 62 that is part of the deflection mechanism 70, as will be described below. The charge electrode 62 is variably biased by a charging waveform source 63. The charging waveform source 63 provides charging waveform 64, also called a charge electrode waveform, in the form of a sequence of charging pulses. The charging waveform is periodic, having a charging waveform period 80. The charging waveform comprises a first voltage state 82 and a second voltage state 84. An embodiment of a charging electrode waveform 64 is shown in FIG. 4B. Drops breaking off during the first voltage state are charged to a first charge state and drops breaking off during the second voltage state are charged to a second charge state. The second voltage state is typically at high level, biased sufficiently to charge the droplets as they break off. The first voltage state that is typically a low level relative to the printhead 30 such that the first charge state is relatively uncharged when compared to the second charge state. An exemplary range of values of the electrical potential difference between the high level voltage and the low level voltage is 50 to 300 volts and more preferably 90 to 150 volts. When a relatively high level voltage or electrical potential is applied to the charge electrode 62 and a droplet breaks off from the liquid jet 52 in front of the charge electrode 62 (as shown in FIG. 3A), the droplet acquires a charge and is deflected by a deflection means 70 towards the catcher 72. Droplets that strike the catcher face 74 form an ink film 76 on the face of the catcher. The ink film flows down the catcher face and enters the liquid return duct 78, through which it flows to the recycling unit 44. The liquid return duct 78 is typically formed between the body of the catcher 72 and the catcher bottom plate 79.

Deflection occurs when droplets break off from the liquid jet while the potential of the charge electrode or electrode 62 is provided with a voltage or electrical potential having a non-zero magnitude. The droplets will then acquire an induced electrical charge that remains upon the droplet surface. The charge on an individual droplet has a polarity opposite that of the charge electrode and a magnitude that is dependent upon the magnitude of the voltage and the coupling capacitance between the charge electrode and the droplet at the instant the droplet separates from the liquid jet. This coupling capacitance is dependent in part on the spacing between the charge electrode and the droplet as it is breaking off. Once the charged droplets have broken away from the liquid jets, the droplets will travel in close proximity to the catcher face 74 which is typically constructed of a conductor or dielectric. The charges on the surface of the droplet will induce either a surface charge density charge (for the catcher constructed of a conductor) or a polarization density charge (for the catcher constructed of a dielectric). The induced charges on the catcher produce an attractive force on the charge drops. The attractive force on the charge drops is identical to that which would be produced by a fictitious charge (opposite in polarity and equal in magnitude) located inside the catcher at a distance from the surface equal to the distance between the catcher and the drop. The fictitious charge is called an image charge. The attractive force exerted on the charged drop 68 by the catcher face 74 causes the charged droplets to deflect away from its initial trajectory 57 and accelerate along a non print trajectory 86 toward the catcher face at a rate proportional to the square of the droplet charge and inversely proportional to the droplet mass. In this embodiment the catcher, due to the induced charge distribution, comprises a portion of the deflection mechanism 70. In other embodiments, the deflection mechanism can include one or more additional electrodes to generate an electric field through which the charged droplets pass so as to deflect the charged droplets. For example, an optional single biased deflection electrode 71 in front of the upper grounded portion of the catcher can be used. In some embodiments, the charging electrode 62 can include a second portion on the second side of the jet array, denoted by the dashed line electrode 62', which supplied with the same charging electrode waveform 64 as the first portion of the charge electrode 62.

In the alternative, when the drop formation waveform 60 applied to the drop forming transducer 28 causes a drop to break off from the liquid stream when the electrical potential of the charge electrode 62 is at the first voltage state, a relatively low potential or at zero potential, the drop 66 does not acquire a charge, travels along a trajectory which is generally on an undeflected path, and impacts the recording medium 32 to form a print dot 88 on the recording medium, as the recoding medium is moved past the printhead 30 at a speed, denoted by arrow $V_m$.

FIG. 4 illustrates how selected drops can be printed by the control of the drop formation waveforms supplied to the drop formation transducer 28. Section A of FIG. 4 shows a sequence 90 of drop formation waveforms that includes three drop forming waveform 92, and four drop forming waveforms 94. The drop forming waveforms 94 each have a period 96 and include a pulse 98, and each of the drop forming waveforms 92 have a longer period 100 and include a longer pulse 102. For identification purposes, the waveforms 92 will be denote as 92-1, 92-2, and 92-3, and the waveforms 94 will be denoted as 94-1, 94-2, 94-3, and 94-4. In this example, the period 96 of the drop forming waveform 94 is the fundamental period $T_o$, and the period 100 of the drop forming waveforms 92 is twice the fundamental period, $2T_o$. The drop forming waveforms 94 each cause individual drops to break off from the liquid stream. The drop forming waveforms 92, due to their longer period, each cause a larger drop to be formed from the liquid stream. The larger drops formed by the waveforms 92 each have a volume that is approximately equal to twice the volume of the drops formed by the waveforms 94.

As previously mentioned, the charged induced on a drop depends on the voltage state of the charging electrode at the instant of drop breakoff. The B section of FIG. 4 shows charge electrode waveform 64 and the times, denoted by the diamonds, at which the drops break off from the liquid stream. The waveform 92-1 caused large drop 104-1 to break off from the liquid stream while the charge electrode waveform 64 is in second voltage state 84. The large drop may be formed as a single drop, denoted by the double diamond for 104-1, as two drops that break off from the liquid stream at almost the same time that subsequently merge to form a large drop, denoted by two closely spaced diamonds for 104-2, or as a large drop that breaks off from the liquid stream that breaks apart and then merges back to a large drop, denoted by the double diamond for 104-3. The waveform 92-2 and 92-3 cause large drops 104-2 and 104-3 to break off during second voltage states 84 of the charge electrode waveform 64. Due to the high voltage applied to the charge electrode in the second voltage state, these drops are charged to a level that causes them to be deflected such that they strike the face 74 of the catcher 72 in FIG. 3. The waveforms 94-1 through 94-4 cause the drops 106-1 through 106-4 to form. Drops 106-1 and 106-3 break off during the first voltage state, and are relatively uncharged. They are not deflected into the catcher, but rather pass by the catcher and strike the print media. Drops 106-2 and 104-4 break off during the second voltage state and are deflected to strike the catcher. The charge electrode waveform is not controlled by the pixel data to be printed, while the drop forming waveform sequence is determined by the print data.

Figure 5:
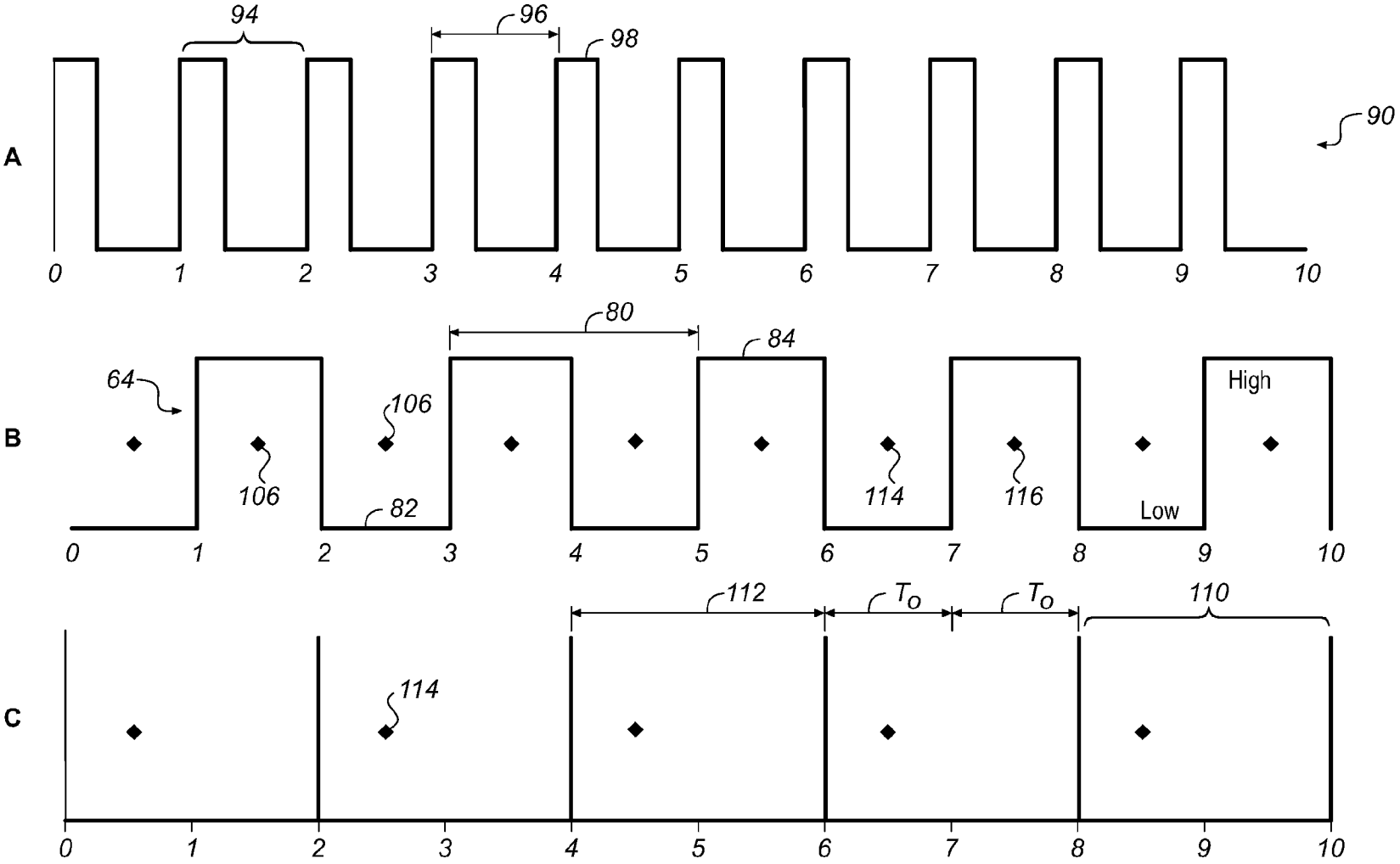
FIG. 5 shows a first example embodiment of a timing diagram illustrating drop formation pulses, the breakoff timing of drops, a first charge electrode waveform, and the timing of pixels at a first print speed.

FIG. 5 illustrates the drop formation waveforms and the charge electrode waveforms for printing one drop on a succession of pixels at a first speed of the print media relative to the printhead. Section A has the sequence 90 of drop forming waveforms, section B has the charge electrode waveform 64, and section C shows the timing of the succession of pixels 110. The horizontal axis for each graph is in units of the fundamental period $T_o$. The first speed of the print media relative to the printhead is also called a first print speed. At this first print speed, two drops 106 are created by the drop formation device during the time interval for each individual pixel 110 spacing to move past the printhead, this time interval is called the pixel period 112. The sequence of drop forming waveforms 94 cause a sequence of small drops 106 to be formed with drop break off events occurring as shown in section B of FIG. 5. The period of the charge electrode waveform is twice the period 96 of the drop forming waveform. As shown, every other drop 106 breaks off during the first voltage state 82 of the charge electrode waveform 64 so that these drops are uncharged. These drops would then bypass the catcher and strike the print media, so these drops are print drops 114. The alternate drops 106 break off during the during the second voltage state 84 of the charge electrode waveform, causing these drops to be charged and subsequently deflected to the catcher. These drops are non-print drops 116

The timing of the print drops 114 from section B is also shown in section C. Section C shows the timing of a sequence of pixels 110 passing the printhead. The vertical lines correspond to imaginary dividing lines between pixels. The time interval, or period 112 for each pixel is equal to two fundamental periods $T_o$. As shown the timing between the print drops 114 is consistent, so that the print drops striking the print media should be evenly spaced on the print media, striking the print media at a consistent location within the pixel region.

If the print data doesn't call for printing a particular pixel, the two drop forming waveforms 94 which create drops for that pixel interval would be replaced by the drop forming waveform 92, shown in FIG. 4A. As was shown in FIG. 4, a large drop 104 is produced that breaks off during the second charge voltage state 84. The large drop is then charged and deflected to the catcher.

Figure 6:
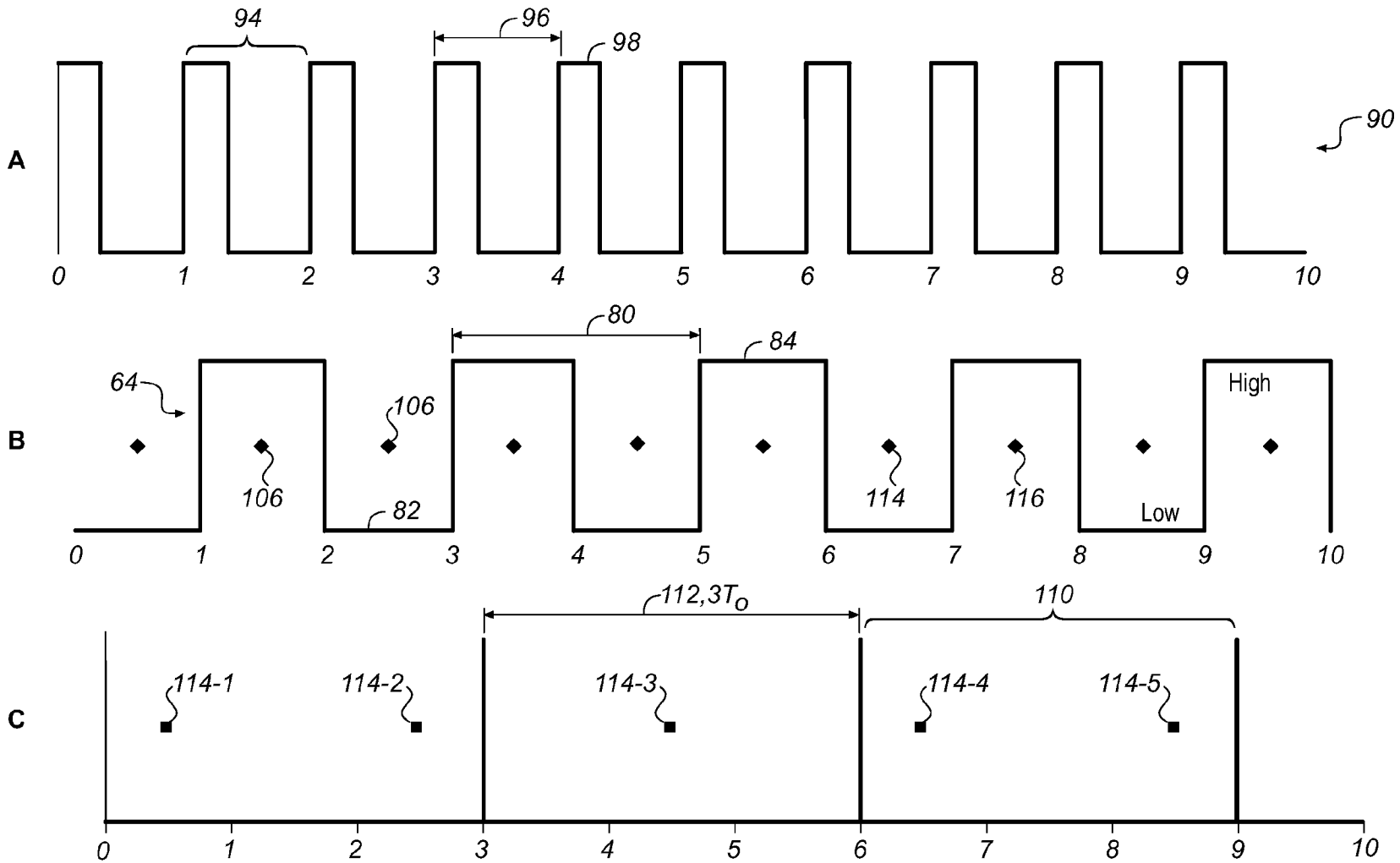
FIG. 6 shows a timing diagram illustrating drop formation pulses, the breakoff timing of drops, the first charge electrode waveform, and the timing of pixels at a second print speed.

FIG. 6 is the same as FIG. 5, but at a different print speed. Section C shows the timing of a succession of pixels 110 passing the printhead at a second exemplary print speed. At this print speed, which is slower than the first exemplary print speed, the pixel period 112 is three times the fundamental drop formation period $T_o$. Also shown in FIG. 6 is the timing of available print drops 114 like that shown in FIG. 5C, when using the same charge electrode waveform 64 as used in FIG. 5. Due to the different print speed, there are now an inconsistent number of available print drops for the pixels. The first and the third pixels in this example would be printed by two drops each, while the second pixel would be printed by a single drop. One could use an alternate drop forming waveforms for the first pixels that would cause either the 106-1 or 106-2 drops in these pixels to become catch drops, and similarly with the third pixel. While that would yield a uniform number of print drops to be applied to the print media in each pixel, the spacing of the drops within the pixels would not be consistent. For example, an alternate drop forming waveform could be used to cause the 106-2 and 106-5 drops to be caught, while allowing drops 114-1 and 114-4 to be printed in the first and third pixels. The drops 114-1 and 114-4 are not centered in the pixel region, but rather are biased to the lead edge of the pixel region. In the second pixel the drop 114-3 is however centered in the pixel region. As a result the distance between the print drops of the first and the second pixel is larger than the distance between the print drops of the second and the third pixels. Such print drop spacing variations can result in visible print density variations.

To overcome this problem, the invention uses a first charge electrode waveform when printing at a first print speed and a second charge electrode waveform when printing at a second print speed. At both print speeds, the charge electrode waveform is independent of the print data.

Figure 7:
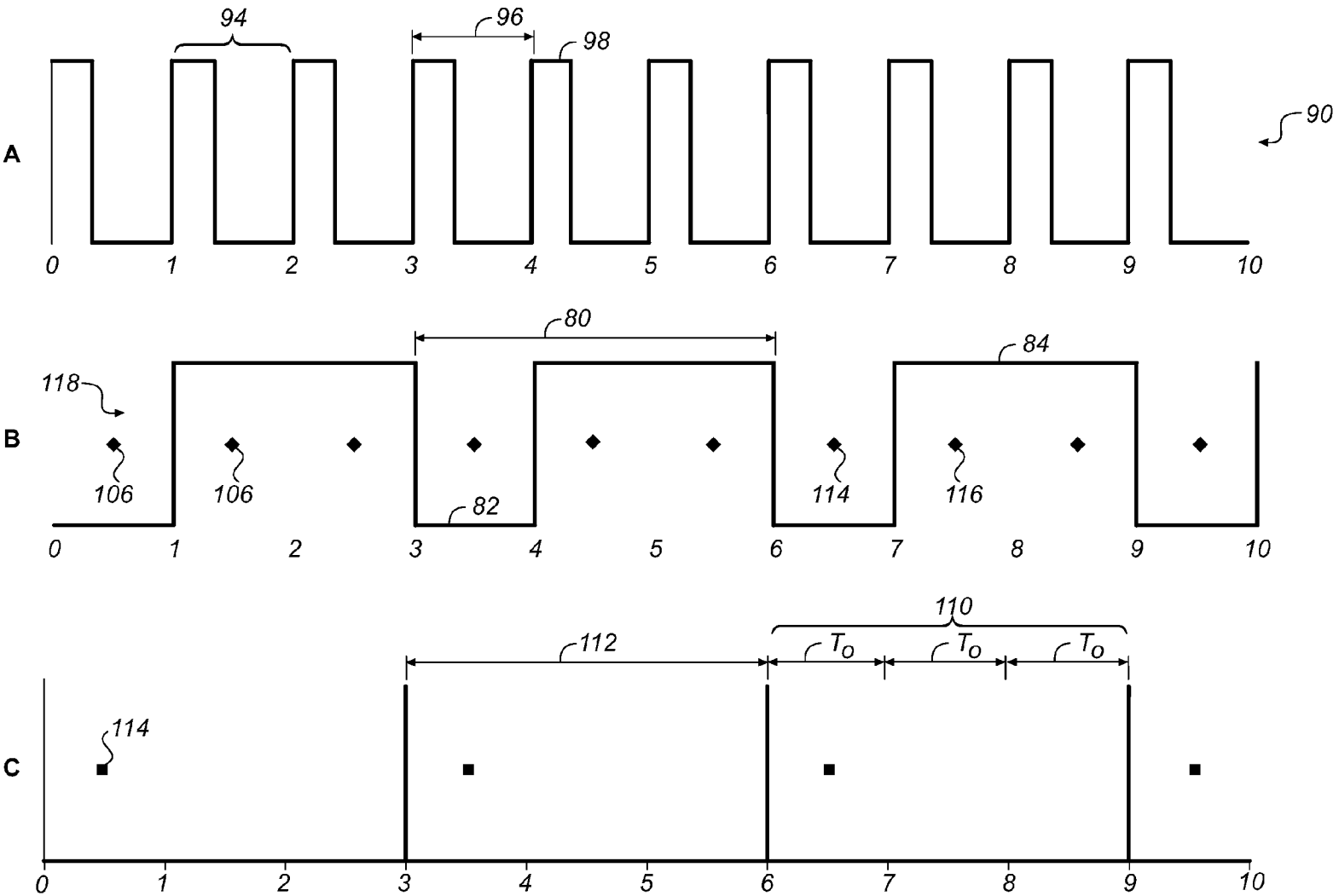
FIG. 7 shows a first example embodiment of a timing diagram illustrating drop formation pulses, the breakoff timing of drops, a second charge electrode waveform, and the timing of pixels at a second print speed.

FIG. 7 illustrates an embodiment of a second charge electrode waveform for use at the second example print speed. The A section of FIG. 7 shows a drop forming waveform 90 applied to the drop forming transducer. The B section of FIG. 7 shows the timing of the drop break off events produced by the drop forming waveform 94 of section A, superimposed on an embodiment of a second charge electrode waveform 118. The C section of FIG. 7 shows the timing of a sequence of pixels 110 passing the printhead. The vertical lines correspond to imaginary dividing lines between pixels. The pixel period 112 is equal to three fundamental drop periods $3T_o$. At this second print speed, the charge electrode waveform 118 has a period different from the period of the first charge electrode waveform 64. The second charge electrode waveform has a period 80 equal to three times the fundamental drop formation period. For each cycle of the charge electrode waveform, one drop 106 breaks off during the low voltage first voltage state 82, and two drops break off during the high voltage, second voltage state 84. As a result a single drop 114 is printed, at a consistent location, within each pixel region.

If the print data doesn't call for printing a particular pixel at this print speed, the first two of the three drop forming waveforms 94 which create drops for that pixel interval would be replaced by the drop forming waveform 92, shown in FIG. 4A. That drop forming waveform produces a large drop 104 that breaks off during the second charge voltage state 84, along with the small drop produced by the third drop forming waveform 94. Both the large drop and the small drop are then charged and deflected to the catcher.

In comparing the first charge electrode waveform shown in FIG. 5 for use at a first print speed and the second charge electrode waveform shown in FIG. 7, it is seen that the problem encountered in FIG. 6C was overcome by using charge electrode waveforms whose period 80 depends on the speed of the recoding medium relative to the drop ejector or printhead. In both these cases, the charge electrode waveform period measured in fundamental drop periods $T_o$ corresponds to the number of fundamental drops formed during the pixel period. The pixel period 112 depends not only on the relative speed between the receiver and the drop ejector, but also on the print resolution. As the frequency at which pixels pass the drop ejector equals the product of the image resolution (pixels/distance) times the print speed (distance/time), it is apparent that the pixel period is dependent on the image resolution as well as the relative speed of the receiver to the drop ejector. The period 112 of the charge electrode waveform 64 should therefore depend on print resolution as well as on the print speed. These two charge electrode waveforms, of FIG. 5B and FIG. 7BC, differ in their periods. They however both had first voltage states 82 whose time durations were the same. The time duration of the second voltage states differed for the two charge electrode waveforms. The duty cycles for the two waveforms also differed, or were distinct, when compared to each other; the duty cycle being the ratio of the waveform pulse time to the time for entire waveform. The duty cycle of the example first charge electrode waveform of FIG. 5B is ½, while the duty cycle of the example second charge electrode waveform of FIG. 7B is ⅔.

Figure 8:
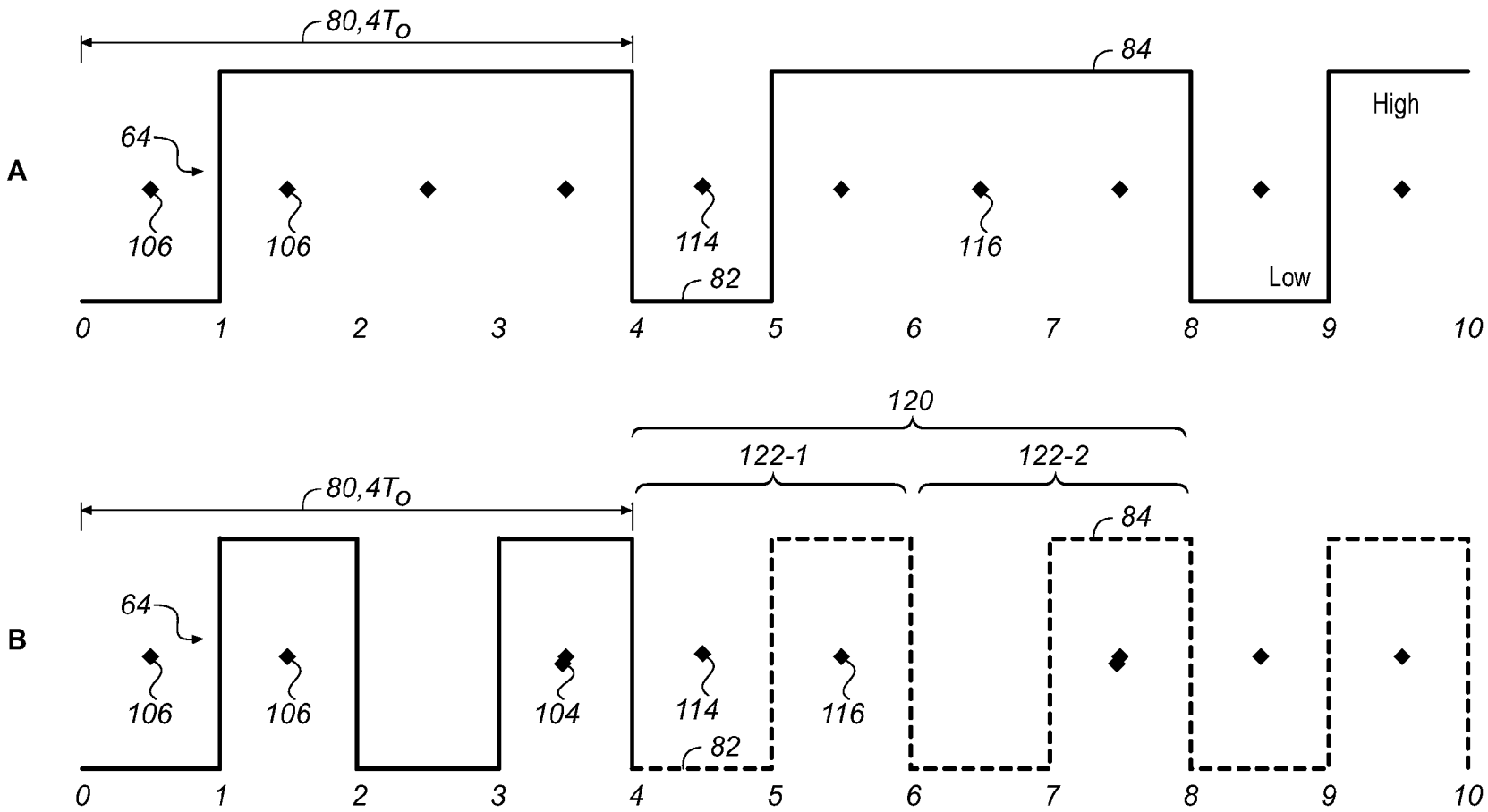
FIG. 8 shows embodiments of timing diagrams illustrating the breakoff timing of drops and third charge electrode waveforms for use at a third print speed.

FIG. 8 shows an embodiment of a charge electrode waveform for use at a print speed at which pixel rate is one fourth the fundamental frequency $f_o$. FIG. 8A shows a single cycle of a charge electrode waveform 64 having a first voltage state 82 of one fundamental period $T_o$ and a second voltage state of three fundamental periods $3T_o$ for a total period for the charge electrode waveform of four fundamental periods 4 $T_o$. This charge electrode waveform allows single print drops to be printed to consistent locations within each pixel region when printing at this print speed. FIG. 8B shows a single cycle of an alternate charge electrode waveform for use at this same print speed that can also allow single print drops to be printed to consistent locations within each pixel region. This alternate charge electrode waveform is a compound waveform 120 made up of two consecutive sub-waveforms 122, each a waveform having a period of two fundamental periods. For consistency of print drop placement within the pixel region, print drops are created only during one of the two sub-waveforms 122-1, while only catcher drops are formed by the drop forming waveforms applied to the drop forming transducer during the other sub-waveform 122-2. A large drop waveform 92 is used to form a single large drop during the second voltage state 84 of the sub-waveform 122-2. Either a small drop waveform 94 or a large drop waveform 92 can be used, based on the print data to form the desired print or non-print drops during the sub-waveform 122-1.

Figure 9:
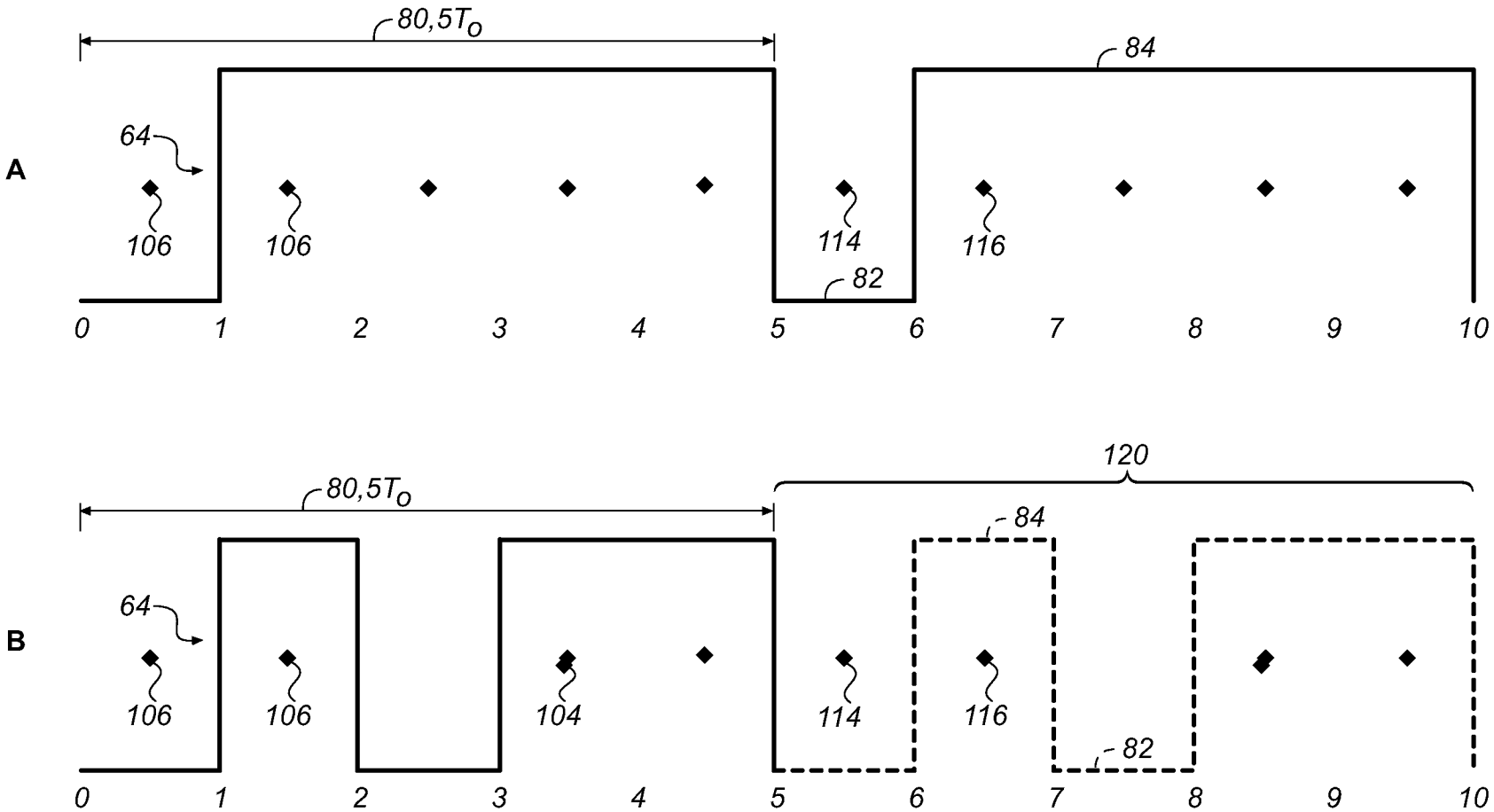
FIG. 9 shows embodiments of timing diagrams illustrating the breakoff timing of drops and third charge electrode waveforms for use at a fourth print speed.

FIG. 9 shows an embodiment of a charge electrode waveform for use at a print speed at which pixel rate is one fifth the fundamental drop forming frequency. FIG. 9A shows a single cycle of a charge electrode waveform having a first voltage state 82 of one fundamental period $T_o$ and a second voltage state 84 of four fundamental periods $4T_o$ for a total period 80 for the charge electrode waveform of five fundamental periods $5T_o$. This charge electrode waveform allows single print drops to be printed to consistent locations within each pixel region when printing at this print speed. FIG. 9B shows a single cycle of an alternate charge electrode waveform for use at this same print speed that can also allow single print drops to be printed to consistent locations within each pixel region. This alternate charge electrode waveform is a compound waveform 120 made up of two consecutive sub-waveforms 122; the first sub-waveform 122-1 having a period of two fundamental periods $2T_o$ and the second sub-waveform 122-2 having a period of three fundamental periods $3T_o$. For consistency of print drop placement within the pixel region, print drops are created only during one of the two sub-waveforms 122-1, while only catcher drops are formed by the drop forming waveforms applied to the drop forming transducer during the other sub-waveform 122-2. A large drop waveform 92 is used to form a single large drop during the second voltage state 84 of the sub-waveform 122-2. Either a small drop waveform 94 or a large drop waveform 92 can be used, based on the print data to form the desired print or non-print drops during the sub-waveform 122-1.

It is apparent from FIGS. 8 and 9, that at any print speed slower than print speed of FIG. 9 that a charge electrode waveform appropriate for that printhead can be formed as a single waveform or as a charge electrode waveform formed as a collection of charge electrode sub-waveforms. It has been found that when printing with a linear array of nozzles, print quality is enhanced by phase shifting the print drops printed by the even numbered nozzles relative to the print drops printed by the odd numbered nozzles. Charge electrode waveforms that are made up of multiple sub-waveforms, each sub-waveform having a first voltage state and a second voltage state, allow the option of providing the desired phase shift between the even and the odd numbered nozzles by allowing the print drops to be formed during the first voltage state of different sub-waveforms. For example, the odd numbered nozzles can form drops for printing during the first voltage state 82 of the first sub-waveform 122-1, while the even numbered nozzles can form drops for printing during the first voltage state 82 of the second sub-waveform 122-2. This creates the desired offset between the print drops of adjacent nozzles to avoid excessive drop-drop interactions, while keeping the stagger of the print dots on the recording medium to less than a pixel shift.

Figure 10:
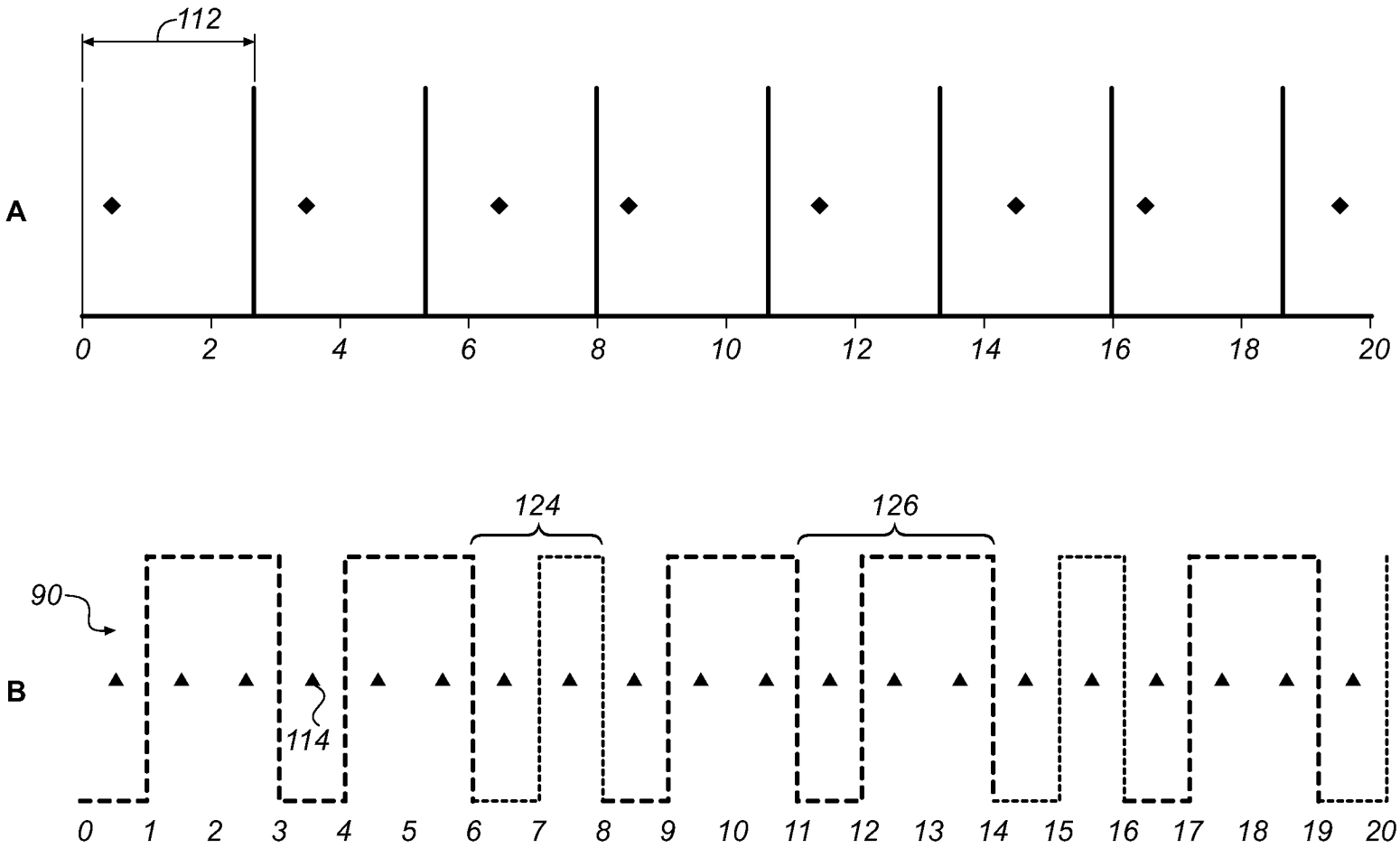
FIG. 10 shows an embodiment of a timing diagram illustrating the breakoff timing of drops, charge electrode waveform, and the timing of pixels at a print speed intermediate between the first and second print speed.

FIG. 5 showed a charge electrode waveform that is appropriate for a first print speed at which the pixel rate is one half the fundamental frequency $f_o$. FIG. 7 shows a charge electrode waveform that is appropriate for a second print speed at which the pixel rate is one third the fundamental frequency $f_o$. FIG. 10A illustrates the timing of successive pixels printing at a print speed intermediate to the first speed and the second print speed. In the example of FIG. 10, the print speed and resolution are such that there are on average 2.7 fundamental periods per pixel period 112. At such intermediate print speeds, a sequence 90 of charge electrode waveforms 64 is used, made up a fraction of the first charge electrode waveforms 124 and the remaining fraction made up of the second charge electrode waveform 126. By using a sequence of charge electrode waveforms made up of a combination of the first and second charging electrode waveforms, having periods of 2 and 3 fundamental drop forming periods respectively, each pixel can be printed with a single drop 114 as shown in FIG. 10B. While there is some variation of the placement of the printed drop within the pixel, the variation in placement of the printed drops within the pixel regions is less than if a single charge electrode waveform, such as that of the first charging electrode waveform 124, were to be used at this print speed. In certain embodiments, the printing system determines mix ratio of different charge electrode waveforms based on a measurement of the print speed. Print speed measurement can be accomplished using a conventional print speed measurement device 35 (shown in FIG. 1) including, for example, an encoder measuring the rotation speed of a roller over which a print media or receiver travels. In other embodiments, the print system includes a clock that creates clock pulse at the fundamental period. The printing system determines on a pixel by pixel basis the number of clock pulses in each pixel time interval and a charge electrode waveform having a corresponding period is selected for that pixel interval. The selection of charge electrode waveforms depends on the print speed and/or the number of fundamental drop forming periods in the pixel time interval, but not on the print data for the pixel. That is, the charge electrode waveform used during a particular pixel interval doesn't depend on whether a drop is to be printed on that pixel or not.

To minimize drop to drop interactions between print drops as they fly from the drop ejector to the receiver, certain embodiments of the invention bias the first voltage state 82 away from the ground condition. This is done so that the charge induced on print drops by the bias potential or voltage on the charge electrode cancels out the charge induced on those drops by the charge on preceding drops. The bias voltage is typically determined by measuring the drop charge on the print drops, and adjusting the bias voltage to yield an average charge on the print drops of zero charge. At the first print speed, each potential print drop is preceded by a single charged catch drop. At the second print speed, each potential print drop is preceded by two charged catch drops. As a result of the difference in the number of charged catch drops that precede each print drops, certain embodiments have a first charge electrode waveform with first voltage state having a first bias voltage at a first print speed and a second charge electrode waveform having a second bias voltage for the first voltage state.

Figure 11:
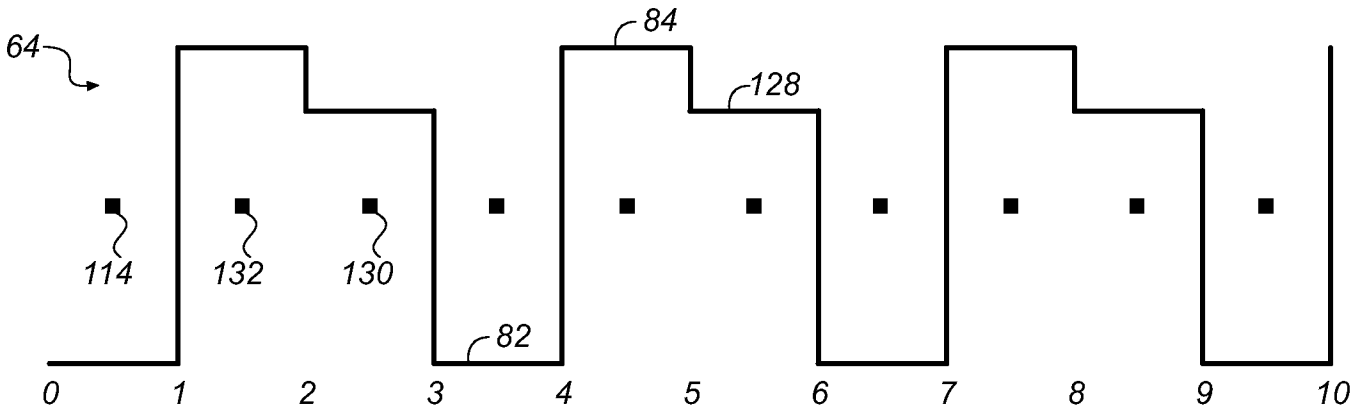
FIG. 11 shows a timing diagram illustrating an embodiment of a charge electrode waveform.

In certain embodiments, one of the first and the second charge electrode waveforms, can include a third voltage state 128, as shown in FIG. 11. The second voltage state 84 and the third voltage state 128 would be selected to ensure that the non-print drops 116 formed during those voltage states are charged sufficiently to allow those drops to be deflected to strike the catcher. The voltage of the third voltage state 128 would then be adjusted relative to the voltage of the second voltage state 84 such that the bias voltage of the first voltage state 82 needed to produce uncharged print drops matches the bias voltage for the first voltage state of the other charge electrode waveform.

In an alternate embodiment, which uses a third voltage state 128 in one of the first and second charge electrode waveforms, the third voltage state is adjusted to provide more consistent deflection to the catcher drops. This can be beneficial in embodiments of the invention that use a drop charging and deflecting electrode configuration as shown in FIG. 3. In that configuration, the electrode 62 serves not only as a charging electrode to charge the drops but also as a deflection electrode to deflect the charged drops. Each cycle of the charge electrode waveform includes a relatively low voltage, first voltage state 82. During the first voltage state, the drop deflection field is effectively turned off, lowering the deflection of the charged drops. The amount by which the deflection is reduced for a charged drop depends on whether the first voltage state takes place during the fundamental drop forming period immediately following the formation of the charged drop, such as drop 130 or whether the first voltage state is delayed by one or more fundamental drop forming periods after the formation of the charged drop, such as drop 132. As a result drop 130 can be deflected by a different amount and drop 132. This difference in deflection amplitude can be reduced by appropriate adjustment of the voltage levels for the second and third voltage states, 84 and 128 respectively. The drop deflection amplitudes, or the drop impact positions on the catcher, are compared and adjustments made to the voltage level of the third voltage state relative to the second voltage state to achieve the desired consistency of drop deflection.

According to the invention, drop forming waveform modified based on print data. The charging waveform is independent of print data. The charging waveform however is dependent on the print speed that is dependent on the rate that pixels spacing are moved past the printhead.

The invention allows drops to be selected for printing or non-printing without the need for a separate charge electrode to be used for each liquid jet in an array of liquid jets as found in conventional electrostatic deflection based ink jet printers. Instead a single common charge electrode is utilized to charge drops from the liquid jets in an array. This eliminates the need to critically align each of the charge electrodes with the nozzles. Crosstalk charging of drops from one liquid jet by means of a charging electrode associated with a different liquid jet is not an issue. Since crosstalk charging is not an issue, it is not necessary to minimize the distance between the charge electrodes and the liquid jets as is required for traditional drop charging systems. The common charge electrode also offers improved charging and deflection efficiency thereby allowing a larger separation distance between the jets and the electrode. Distances between the charge electrode and the jet axis in the range of 25-300 μm are useable. The elimination of the individual charge electrode for each liquid jet also allows for higher densities of nozzles than traditional electrostatic deflection continuous inkjet system, which require separate charge electrodes for each nozzle. The nozzle array density can be in the range of 75 nozzles per inch (npi) to 1200 npi.

In the embodiments of the various figures, the print drops were relatively uncharged and relatively undeflected, while the non-print drops were charged and deflected to strike the catcher. It other embodiments, the print drops can be charged and deflected and the non-print drops be relatively non-charged and relatively undeflected, with the catcher positioned to intercept the trajectory of the undeflected non-print drops.

In the examples described above, the first print speed, second print speed, third print speed and fourth print speeds corresponded to the print speeds at which the pixel periods equaled two time, three times, four times and five times the fundamental period $T_o$, respectively. Those speeds were used only as examples, and are not limiting. The first print speed, second print speed, third print speed and fourth print speeds can be any print speeds that are distinct from each other.

The example embodiments discussed above with reference to FIGS. 1-10 are described using a particular combination of a drop charging structure, drop deflection structure, drop catching structure, and drop formation device. It should be understood that there are many known configurations of drop charging structures (having an electrode on a single side of the jet array or on both sides of the jet array), of drop deflection structures (using parallel deflection electrodes, a deflection electrode opposite a grounded catcher, or no separate deflection electrode), of drop catching structures (including Coanda catcher, knife edge catchers, porous face catchers, and delimited edge catcher), and drop formation devices, including some in which a single structure carries out multiple functions (such as an electrode structure that serves to both charge drops and deflect them). Various combinations of these structures can be employed where appropriate with the invention.

The invention has been described in detail with particular reference to certain preferred embodiments thereof, but it will be understood that variations and modifications can be effected within the scope of the invention.

PARTS LIST

20 Continuous Printer System
22 Image Source
24 Image Processing Unit
26 Mechanism Control Circuits
27 Synchronization Device
28 Drop Forming Device
30 Printhead
32 Recording Medium
34 Recording Medium Transport System
35 Speed Measurement Device
36 Recording Medium Transport Control System
38 Micro-Controller
40 Reservoir
44 Recycling Unit
46 Pressure Regulator
47 Channel
48 Jetting Module
49 Nozzle Plate
50 Nozzle
51 Heater
52 Liquid Stream
54 Drop
55 Drop Formation Waveform Source
57 Trajectory
58 Drop Stream
59 Breakoff Location
60 Drop Formation Waveform
61 Charging Device
62 Charging Electrode
63 Charge Electrode Waveform Source
64 Charge electrode Waveform
66 Print Drop
68 Non-Print drop
70 Deflection Mechanism
71 Deflection Electrode
72 Catcher
74 Catcher Face
76 Ink Film
78 Ink Return Duct
79 Catcher bottom Plate
80 Charging Waveform Period
82 First Voltage State
84 Second Voltage State
86 Non-print Trajectory
88 Print dot
90 Sequence
92 Drop forming waveform
94 Drop forming Waveform
96 Period
98 Pulse
100 Period
102 Pulse
104 Large drop
106 Small drop
108 Phase Shift
110 Pixels
112 Pixel Period
114 Print Drops
116 Non-Print Drops
118 Charge Electrode Waveform
120 Compound Waveform
122 Sub-Waveform
124 First Charge Electrode Waveform
126 Second Charge Electrode Waveform
128 Third Voltage State
130 Drop
132 Drop

The invention claimed is:

1. A system for printing comprising:

a drop ejector including:

a nozzle;

a source of pressurized liquid provided continuously to the nozzle at a pressure sufficient to eject a continuous liquid jet through the nozzle;

a drop formation device associated with the liquid jet;

a drop formation waveform source which provides print drop formation waveforms having a fundamental period and non-print drop formation waveforms to the drop formation device in response to input print data to form print drops and non-print drops from the liquid jet, the print drops and the non-print drops traveling along an initial path;

a transport that provides relative motion between a receiver and the drop ejector at a first speed and provides relative motion between the receiver and the drop ejector at a second speed;

a drop charging device including:

a charging electrode associated with the liquid jet;

a drop charging waveform source which provides a first charging waveform having a period to the charging electrode when the relative motion of the receiver and the drop ejector is at the first speed and provides a second charging waveform having a period to the charging electrode when the relative motion of the receiver and the drop ejector is at the second speed, the first charging waveform being independent of the input print data, the second charging waveform being independent of the input print data, the first charging waveform including a first voltage state and a second voltage state, the second charging waveform including a first voltage state and a second voltage state, the period of the first charging waveform and the period of the second charging waveform being different from each other by one or more fundamental periods of the drop forming waveform;

a synchronization device that synchronizes the drop formation device and the drop charging device to produce a print drop charge state on the print drops and produce a non-print drop charge state on non-print drops, the print drop charge state and the non-print drop charge state being distinct when compared to each other;

a deflection device associated with the print drops and the non-print drops traveling along the initial path that causes the print drops having the print drop charge state to travel along a print drop path and causes the non-print drops having the non-print drop charge states to travel along a non-print drop path; and a catcher positioned to collect the non-print drops traveling along the non-print drop path while allowing the print drops traveling along the print drop path to continue traveling toward the receiver.

2. The system of claim 1, wherein the first charging waveform includes a period that is dependent on the first speed of relative motion between the receiver and the drop ejector, and the second charging waveform includes a period that is dependent on the second speed of relative motion between the receiver and the drop ejector.

3. The system of claim 2, the input print data including an image resolution, wherein the period of the first charging waveform and the period of the second charging waveform is dependent on the image resolution of the input print data.

4. The system of claim 1, the input print data including an image resolution, wherein the period of the first charging waveform and the period of the second charging waveform is dependent on the image resolution of the input print data.

5. The system of claim 1, wherein the first charging waveform includes a first duty cycle and the second charging waveform includes a second duty cycle, the first duty cycle and the second duty cycle being distinct when compared to each other.

6. The system of claim 1, wherein a duration of the first voltage state of the first charging waveform and a duration of the first voltage state of the second charging state are the same.

7. The system of claim 1, wherein the non-print drops include non-print drops of different sizes.

8. The system of claim 1, wherein the non-print drop waveform includes a first period when the relative motion of the receiver and the drop ejector is at the first speed and includes a second period when the relative motion of the receiver and the drop ejector is at the second speed.

9. The system of claim 1, wherein at least one of the first charging waveform and the second charging waveform includes a third voltage state.

10. The system of claim 1, wherein the non-print drops include a plurality of separately formed non-print drops that merge to form the non-print drops.

11. The system of claim 10, wherein one of the plurality of separately formed non-print drops is formed during the first voltage state of one of the first charging waveform and the second charging waveform, and another of the plurality of separately formed non-print drops is formed during the second voltage state of the corresponding one of the first charging waveform and the second charging waveform.

12. A method of printing comprising:

providing a drop ejector including:

a nozzle;

a source of pressurized liquid provided continuously to the nozzle at a pressure sufficient to eject a continuous liquid jet through the nozzle;

a drop formation device associated with the liquid jet;

a drop formation waveform source which provides print drop formation waveforms having a fundamental period and non-print drop formation waveforms to the drop formation device in response to input print data to form print drops and non-print drops from the liquid jet, the print drops and the non-print drops traveling along an initial path;

providing a drop charging device including:

a charging electrode associated with the liquid jet;

a drop charging waveform source;

providing relative motion between a receiver and the drop ejector at a first speed and providing relative motion between the receiver and the drop ejector at a second speed using a transport;

providing a first charging waveform having a period to the charging electrode when the relative motion of the receiver and the drop ejector is at the first speed and providing a second charging waveform having a period to the charging electrode when the relative motion of the receiver and the drop ejector is at the second speed using the drop charging waveform source, the first charging waveform being independent of the input print data, the second charging waveform being independent of the input print data, the first charging waveform including a first voltage state and a second voltage state, the second charging waveform including a first voltage state and a second voltage state, the period of the first charging waveform and the period of the second charging waveform being different from each other by one or more fundamental periods of the drop forming waveform;

synchronizing the drop formation device and the drop charging device using a synchronization device to produce a print drop charge state on the print drops and produce a non-print drop charge state on non-print drops, the print drop charge state and the non-print drop charge state being distinct when compared to each other;

causing the print drops having the print drop charge state to travel along a print drop path and causing the non-print drops having the non-print drop charge states to travel along a non-print drop path using a deflection device; and collecting the non-print drops traveling along the non-print drop path using a catcher while allowing the print drops traveling along the print drop path to continue traveling toward the receiver.

13. The method of claim 12, wherein the first charging waveform includes a period that is dependent on the first speed of relative motion between the receiver and the drop ejector, and the second charging waveform includes a period that is dependent on the second speed of relative motion between the receiver and the drop ejector.

14. The method of claim 13, the input print data including an image resolution, wherein the period of the first charging waveform and the period of the second charging waveform is dependent on the image resolution of the input print data.

15. The method of claim 12, the input print data including an image resolution, wherein the period of the first charging waveform and the period of the second charging waveform is dependent on the image resolution of the input print data.

16. The method of claim 12, wherein the first charging waveform includes a first duty cycle and the second charging waveform includes a second duty cycle, the first duty cycle and the second duty cycle being distinct when compared to each other.

17. The method of claim 12, wherein a duration of the first voltage state of the first charging waveform and a duration of the first voltage state of the second charging state are the same.

18. The method of claim 12, wherein the non-print drops include non-print drops of different sizes.

19. The method of claim 12, wherein the non-print drop waveform includes a first period when the relative motion of the receiver and the drop ejector is at the first speed and includes a second period when the relative motion of the receiver and the drop ejector is at the second speed.

20. The method of claim 12, wherein at least one of the first charging waveform and the second charging waveform includes a third voltage state.

21. The method of claim 12, wherein the non-print drops include a plurality of separately formed non-print drops that merge to form the non-print drops.

22. The method of claim 21, wherein one of the plurality of separately formed non-print drops is formed during the first voltage state of one of the first charging waveform and the second charging waveform, and another of the plurality of separately formed non-print drops is formed during the second voltage state of the corresponding one of the first charging waveform and the second charging waveform.

23. A method of printing comprising:

providing a drop ejector including:

a nozzle;

a source of pressurized liquid provided continuously to the nozzle at a pressure sufficient to eject a continuous liquid jet through the nozzle;

a drop formation device associated with the liquid jet;

a drop formation waveform source which provides print drop formation waveforms having a fundamental period and non-print drop formation waveforms to the drop formation device in response to input print data to form print drops and non-print drops from the liquid jet, the print drops and the non-print drops traveling along an initial path;

providing a drop charging device including:

a charging electrode associated with the liquid jet;

a drop charging waveform source;

measuring a first speed of relative motion between a receiver and the drop ejector and measuring a second speed of relative motion between the receiver and the drop ejector using a speed measurement device;

providing a first charging waveform having a period to the charging electrode when the relative motion of the receiver and the drop ejector is at the first speed and providing a second charging waveform having a period to the charging electrode when the relative motion of the receiver and the drop ejector is at the second speed using the drop charging waveform source, the first charging waveform being independent of the input print data, the second charging waveform being independent of the input print data, the first charging waveform including a first voltage state and a second voltage state, the second charging waveform including a first voltage state and a second voltage state, the period of the first charging waveform and the period of the second charging waveform being different from each other by one or more fundamental periods of the drop forming waveform;

synchronizing the drop formation device and the drop charging device using a synchronization device to produce a print drop charge state on the print drops and produce a non-print drop charge state on non-print drops, the print drop charge state and the non-print drop charge state being distinct when compared to each other;

causing the print drops having the print drop charge state to travel along a print drop path and causing the non-print drops having the non-print drop charge states to travel along a non-print drop path using a deflection device; and collecting the non-print drops traveling along the non-print drop path using a catcher while allowing the print drops traveling along the print drop path to continue traveling toward the receiver.

* * * * *